US005184696A

United States Patent [19]

Meed et al.

[11] Patent Number: 5,184,696

[45] Date of Patent: Feb. 9, 1993

[54] FALL ARREST BELT ASSEMBLY

[76] Inventors: Myles Meed, P.O. Box 7, Bristol, New Brunswick, Canada, E0J 1G0; Paul Porter, P.O. Box 5050, Grand Falls, New Brunswick, Canada, E0J 1M0

[21] Appl. No.: 847,407

[22] Filed: Mar. 6, 1992

[51] Int. Cl.[5] ..... A62B 35/00

[52] U.S. Cl. ..... 182/9; 182/133

[58] Field of Search ..... 182/9, 8, 3, 133-136, 182/187

[56] References Cited

U.S. PATENT DOCUMENTS 2,879,830 3/1959 Johnson ..... 182/187
3,407,898 10/1968 Johnson ..... 182/9
4,579,196 4/1986 Allen et al. ..... 182/9
4,595,078 6/1986 Greenway ..... 182/9
4,712,646 12/1987 Page ..... 182/9

*Primary Examiner*—Alvin C. Chin-Shue
*Attorney, Agent, or Firm*—Bereskin & Parr

[57] ABSTRACT

A fall arrest belt assembly attaches to the body belt of a climber who climbs wooden utility poles or trees. The belt assembly has an outer strap to fit around the pole, an elastic cross strap to pull the outer belt against the pole, and a safety device on the outer strap. The safety device has a large tooth that is normally latched in a recessed or closed position. If the climber falls, a barb on the tooth pulls the tooth to an open position, assisted by a spring which helps deploy the tooth and hold it open. The tooth penetrates the pole and prevents falling. A pair of balls on the cross strap prevent abrasion of the cross strap on the pole.

13 Claims, 5 Drawing Sheets

FALL ARREST BELT ASSEMBLY

FIELD OF THE INVENTION

This invention relates to fall arrest belt assemblies used by workers who climb wooden utility poles and large trees.

BACKGROUND OF THE INVENTION

While today's line worker tends to rely on a hydraulic boom and bucket to reach electrical power lines or telephone poles, there are still instances where the line worker must manually climb a pole. This is the case where the pole cannot be reached by the boom truck, for example, a pole situated in the middle of a field in a rural setting. Having less practice, the worker is at increased risk of falling during such climbing.

To climb a pole, the line worker typically uses climbing spikes or spurs, and a climbing belt made from leather or suitable synthetic material. The climbing belt passes around the far side of the pole and attaches to a body-belt or harness which is worn by the line worker. The climbing spikes face inward to the pole and penetrate the pole giving the climber purchase for climbing. The climbing belt provides a climbing aid to the climber and also holds him to the pole and helps support his weight, freeing his hands.

While the climbing belt helps support the climber if used during ascent and descent (and also in the work position), problems occur if the climber loses his footing and begins to fall. In such a situation, or, if the worker has been standing upright on his spurs to be close to the pole and its equipment, and he then slips, the pressure of the climber's weight against the climbing belt may be relieved, so that the belt no longer pulls against the pole. This permits the climber to fall and be seriously injured or even killed. To arrest the climber during a fall, various fall arrest features have been incorporated into climber safety devices.

U.S. Pat. No. 4,407,391, which issued to Greenway et al., on Oct. 4, 1983 discloses a fall arrest device comprising a yoke with a safety belt attachment and handles for the climber. The yoke is formed from metal and closes around the pole. On the underside of the yoke, there are blades which can pivot and which, in their closed position, bite into the pole. Either counterweights on the blades, or torsion springs, hold them in the closed position. In operation, the climber holds the blades in the open position and lifts the yoke as he climbs the pole. Should the climber fall, he will normally release the blade handles and they will close either by the spring action or by the force of the counterweights, and will bite into the pole.

The device as taught by Greenway suffers a major drawback, namely, ease of use in the field. It will be appreciated that the usefulness of a fall arrest device depends on the line climber's willingness to use it. The Greenway device, besides being very heavy when compared to conventional safety belts, is very difficult to operate around obstructions on the pole (which are frequent). Furthermore, the yoke is not readily adjustable to different size poles. For these reasons, climbers have been quite reluctant to use this fall arrest device.

U.S. Pat. No. 4,579,196, which issued to Allen et al. on Apr. 1, 1986, discloses a climber fall arrest belt assembly having an outer strap and an inner strap. The outer strap includes downwardly directed teeth which are designed to bite into the pole. The outer strap wraps around the outside surface of the utility pole and connects to the climber's body-belt. The inner strap clips across the outer strap on the inner side of the pole but requires adjustment by the worker to fit the pole. In the event of a fall the teeth on the outer strap bite into the pole and the inner strap cooperates with the outer strap by bearing the climber's weight to stop the fall. The Allen invention suffers from the major drawback of having the fall arresting teeth always in the engaged position. Not only can the teeth catch during normal ascent and descent of the pole, but also the points on the teeth will tend to dull, thereby risking a failure in the event of the fall. In addition, the Allen invention uses friction between the inner strap and utility pole to bear some of the fallen climber's weight.

Accordingly, the problem remains to provide a fall arrest assembly which is reliable and easy to use by a line worker or other climber in the field. The prior art, while teaching various fall arrest devices, fails to provide a device which is not cumbersome and which does not interfere with the climber's normal ascent or descent of a utility pole. In addition, in the prior art, adjustment of the device to the changing diameters of poles is usually awkward.

SUMMARY OF THE INVENTION

Accordingly, it is an object of the present invention to provide a fall arrest device for a line worker or other climber which lends itself to ease of use in the field and which does not interfere with normal ascent or descent while providing improved fall protection.

In one aspect, the present invention provides a belt assembly for use with a body belt worn by a climber for climbing a utility pole or the like, said belt assembly comprising:

(a) an outer strap adapted to fit around said utility pole, said outer strap having a pair of ends adapted to be attached to said body belt, (b) a cross-over strap having a pair of ends connected to said outer strap at locations spaced from the ends of said outer strap, said inner strap being adapted to define and maintain, with the portion of said outer strap extending between the ends of said inner strap, a closed snug loop around said pole, (c) a safety device connected to said portion of said outer strap, (d) said safety device having a tooth, and means mounting said tooth for movement between an open position and a closed position, (e) said safety device further including latching means coupled to said tooth and normally retaining said tooth in said closed position, (f) said safety device including tooth deployment means responsive to said climber falling, for releasing said tooth from said latching means and for moving said tooth into said open position so that said tooth will penetrate into said pole, said deployment means including activation means for contacting said pole if said climber falls, for instituting operation of said deployment means.

BRIEF DESCRIPTION OF THE DRAWINGS

For a better understanding of the present invention in its various aspects, and to show more clearly how it may be carried into effect, reference will now be made, by way of example, to the accompanying drawings in which.

DETAILED DESCRIPTION OF THE PREFERRED EMBODIMENTS

Figure 1:
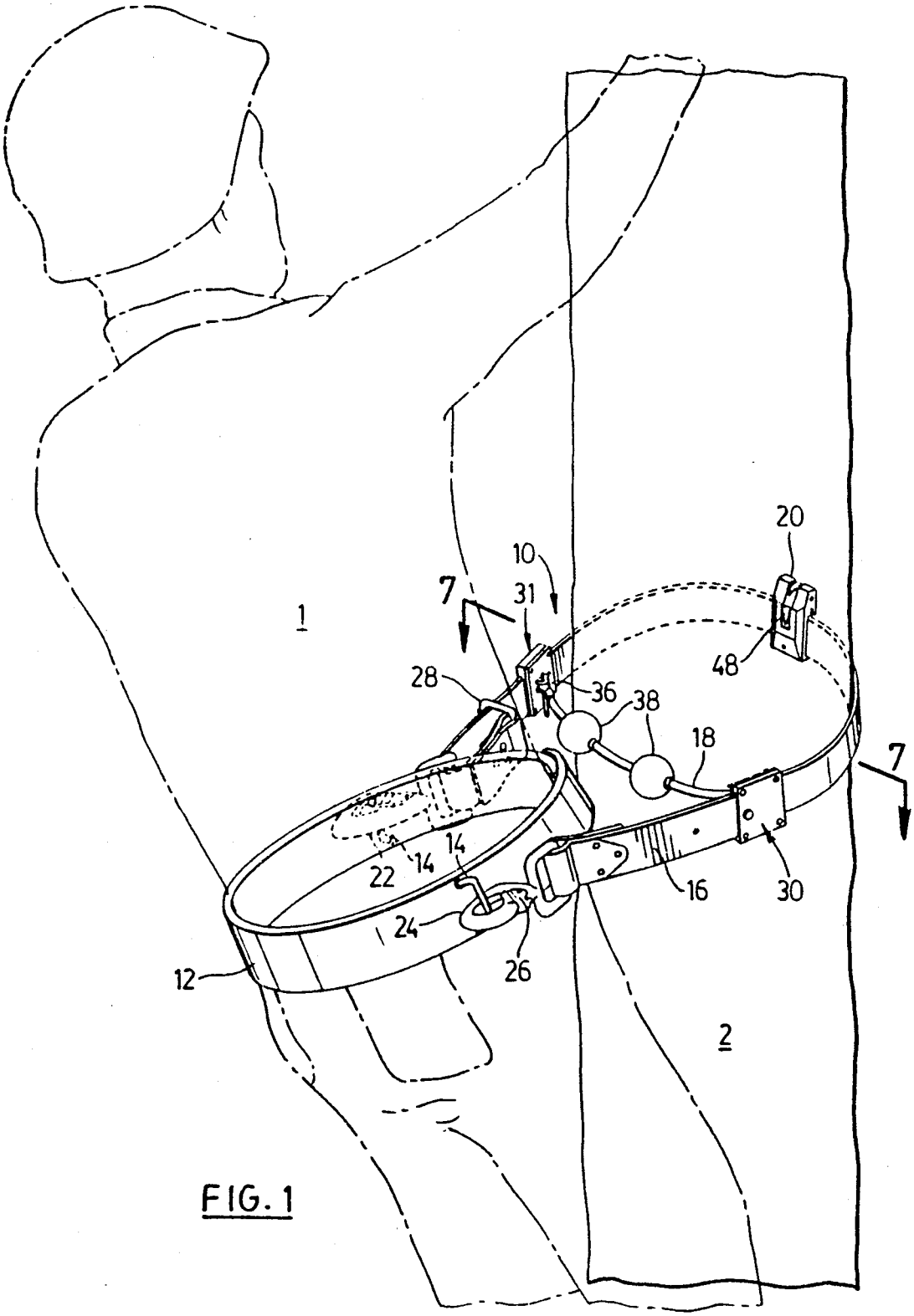
FIG. 1 shows a line worker or other climber wearing a belt assembly comprising an other strap, a cross-over strap and a safety device, according to the present invention.

FIG. 1 shows a line worker or other climber 1 climbing a utility pole or tree 2 using a belt assembly 10 according to the present invention. The belt assembly 10 attaches to a body-belt 12 worn by the climber 1. The body-belt 12 has connecting rings 14 (called "D rings") at opposite ends for attaching to the belt assembly 10. In climbing the utility pole or tree 2, the climber 1 also wears climbing spikes or spurs (not shown).

Figure 2:
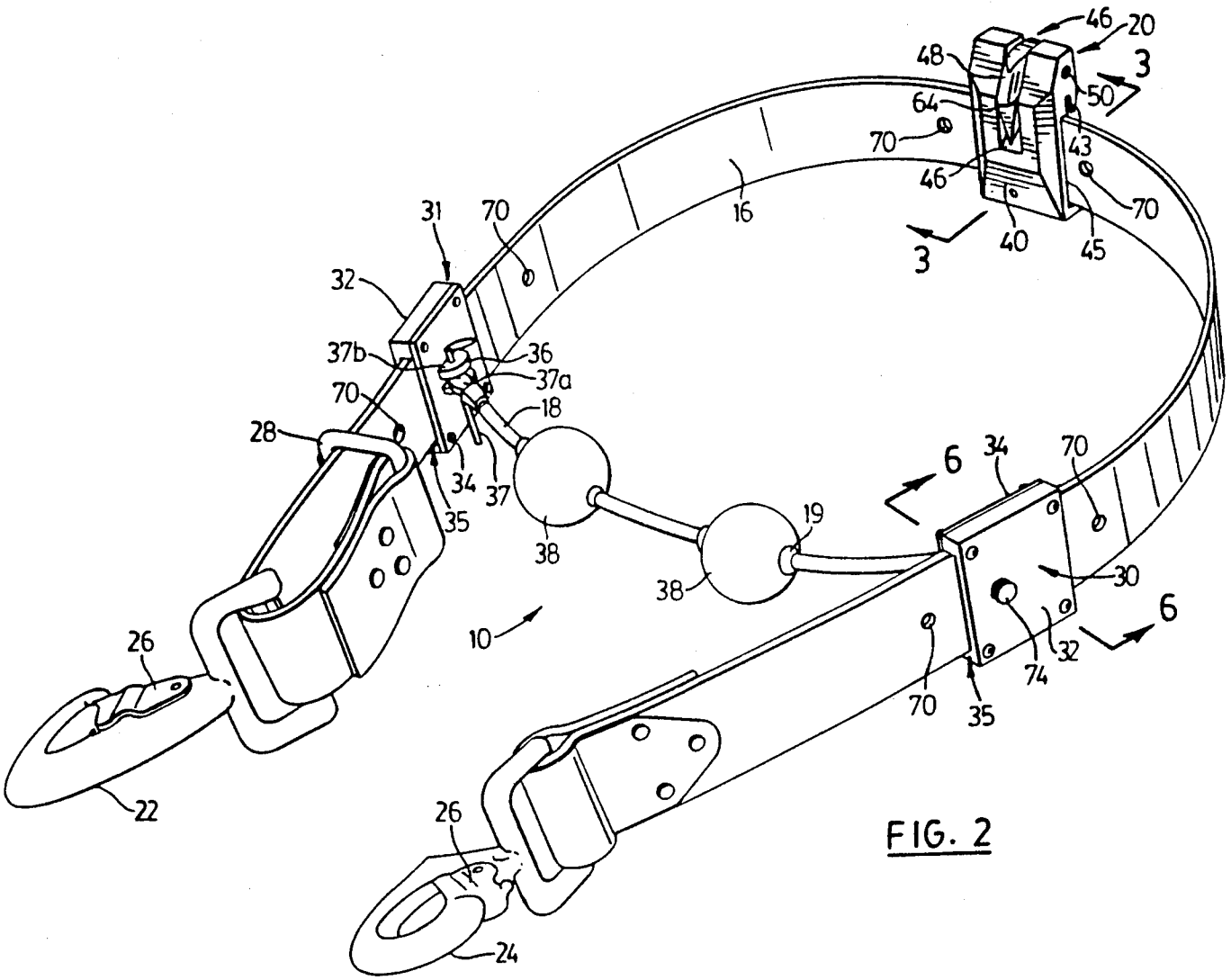
FIG. 2 is a perspective view of a belt assembly incorporating the safety device.

Referring to FIG. 2, the belt assembly 10 comprises an outer strap 16, a cross-strap or cord 18, and a safety device 20. The outer strap 16 fits around the outer surface of the pole 2. The strap 16 is of conventional design and should be relatively stiff while at the same time having some flexibility. In known manner, it can be made of leather or a webbed nylon or elastomeric material. The outer strap 16 includes a snap hook 22, 24 at each end for connecting to the corresponding D rings 14 on the body-belt 12 (as shown in FIG. 1). To provide a secure connection to the body-belt 12 and avoid unintentional release, the snap hooks 22, 24 should each include a hinged tongue 26. At one or both ends, the outer strap 16 has an adjustment buckle 28 for varying the length of the strap 16 to accommodate poles 2 of varying diameters. Utility poles 2 typically vary between 8 and 18 inches in diameter. To provide the adjustment capability, the buckle end of the outer strap 16 is doubled over and locked in place using the buckle 28.

The cross-strap or cord 18 fits across the near side (i.e. the pole side adjacent to the climber) of the utility pole 2 (FIG. 1). The cross-strap 18 attaches to the outer strap 16 using a pair of sliding buckles 30, 31. Each buckle 30, 31 comprises a front plate 32 and a back plate 34 which define a recess 35 for accepting the outer strap 16. Each buckle 30, 31, in turn, attaches to one end of the cross-strap 18 using a releasable fastener 36. The fastener 36 includes a pin 37 which extends through matched holes in a terminating piece **37*a* on the end of cord 18, and in protrusions 37*b* from plate 34. The pin 37** may have a ball detent near its free end so that it cannot easily be removed inadvertently.

After the outer strap 16 is positioned around the pole 2, and clipped to the body belt 12 via the D rings 14 and snap hooks 22, 24, the climber 1 snaps the cross-strap 18 in place using the fasteners 36. The function of the cross-strap 18 is to keep the outer portion of the outer strap 16 formed in a "loop" shape (see FIG. 7) around the pole 2, i.e. to ensure that it normally hugs or is pulled reasonably tightly around the pole (except when it is moved away from the pole by the climber during a climbing step). The "loop" shape is adjusted by sliding the buckles 30, 31 along the outer strap 16. In addition, the cross-strap 18 keeps the safety device 20 in proximity to the pole 2 as will be discussed below.

As will be explained, the cross-strap 18 according to the present invention (unlike in conventional fall arrest belt designs) does not perform a load-sharing function. Therefore, the cross-strap 18 can be a bungee cord, which as known consists of an elastic core surrounded by a stretchable outer sheath.

Figure 7:
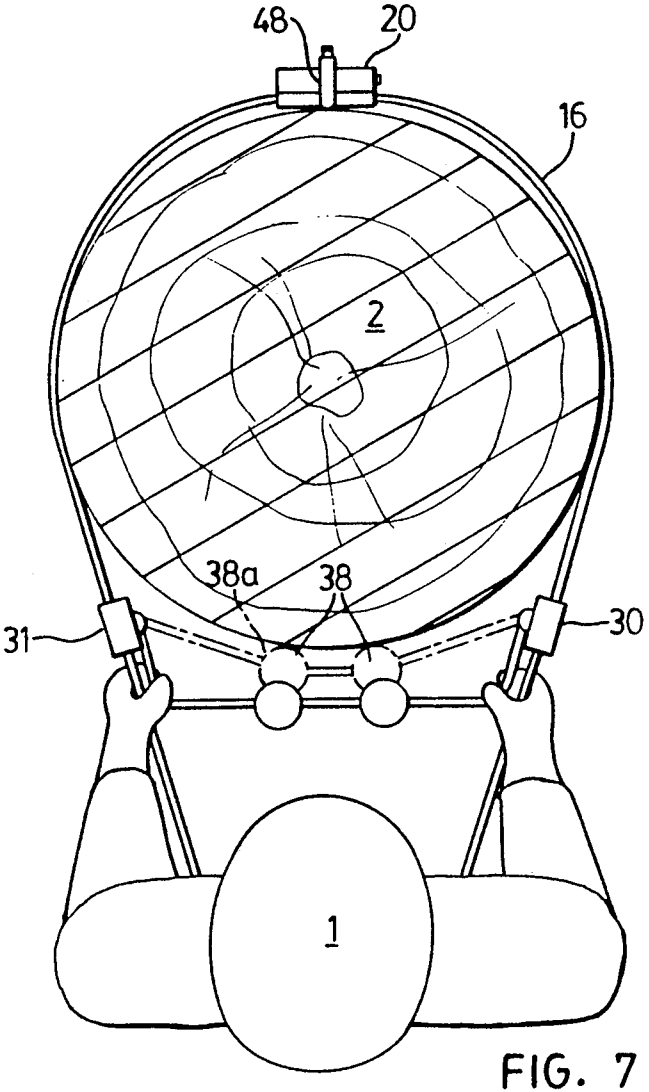
FIG. 7 is a plan view of a climber using the belt assembly according to the present invention.

As shown in FIG. 2, the cross-strap 18 includes a pair of balls 38 mounted thereon. The balls 38 are located near the middle of strap 18 and are prevented from sliding outwardly on the strap 18 by enlargements 19 on the strap 18. The balls 38 serve two principal functions. Firstly, and primarily, the balls 38 by keeping the cross-strap 18 away from the surface of the pole 2 reduce abrasion of the bungee cord 18 against the pole 2 as the climber 1 climbs or descends. Secondly, as shown in FIG. 7, the balls 38 create a space **38*a* between the bungee cord 18 and the pole 2 through which the climber 1 can insert his thumbs even when he is wearing bulky gloves in winter time. The balls 38 are normally positioned spaced from each other and from the ends of cord 18 to best accommodate insertion of the climber's gloves. In the embodiment shown, the balls 18 are approximately equidistant from each other and from the ends of cord 18, dividing cord 18 approximately into thirds, and are held in position against displacement on the cord by enlargements 19 on the cord 18. However, the balls 38 are preferably rotatable on the cord 18** (which passes through holes in the balls) so that the balls can roll up or down the pole during climbing.

To accommodate varying pole or tree diameters, the cross-over strap 18 may have integral length adjustability, or cross-over straps of various lengths may be supplied to the user.

The safety device 20 fits onto a portion of the outer strap 16 between buckles 30, 31, as shown in FIG. 2. When using the belt assembly 10, it is preferable to have the safety device 20 on the outer strap 16 in a position directly across from the climber 1. It is therefore desirable to adjust the position of the safety device 20 if the climber 1 climbs a utility pole 2 having a different diameter. Alternatively two safety devices 20 can be used on outer strap 16, spaced from each other, to cover a range of diameters.

Figure 3:
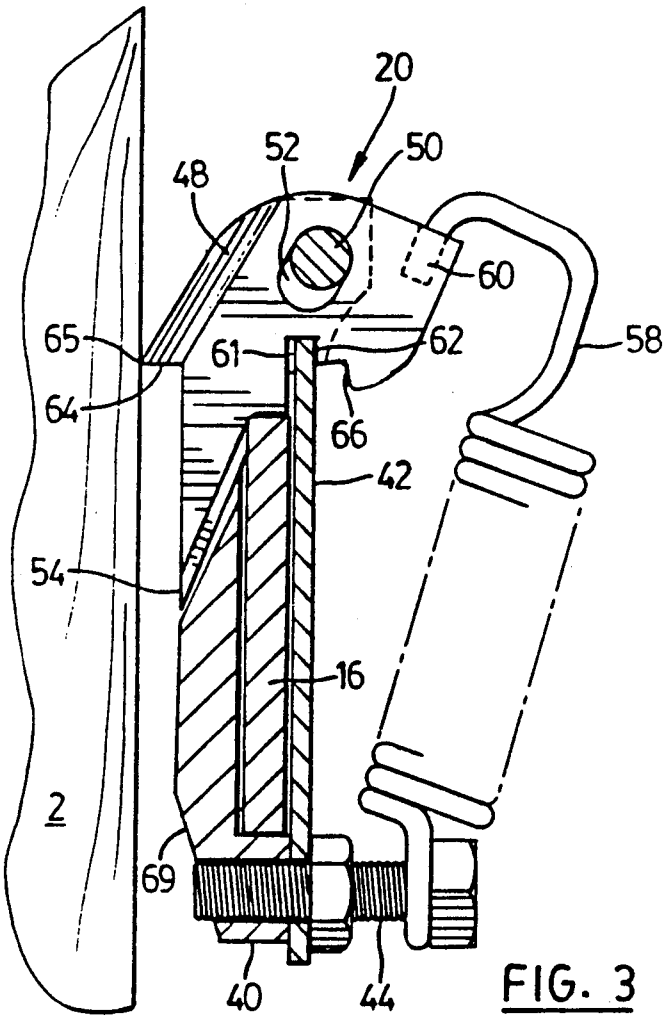
FIG. 3 is a side view and sectional view of the safety device, along line 3—3, in the closed position.

Referring both to FIG. 2 and FIG. 3 (which shows the safety device 20 along section line 3—3), the safety device 20 includes a front plate or housing 40, and a back plate 42. The back plate 42 fits into a mounting slot 43 on the front plate or housing 40 and is secured using a suitable fastener such as a bolt 44. The front plate or housing 40 can be machined from lightweight aluminum or plastic, or can be die-cast or moulded using known methods. The back plate 42 can simply be cut from metal plate having a thickness e.g. between 3 mm and 5 mm. The housing 40 and back plate 42 define between them a slot 45 to accommodate the outer strap 16.

Figure 4:
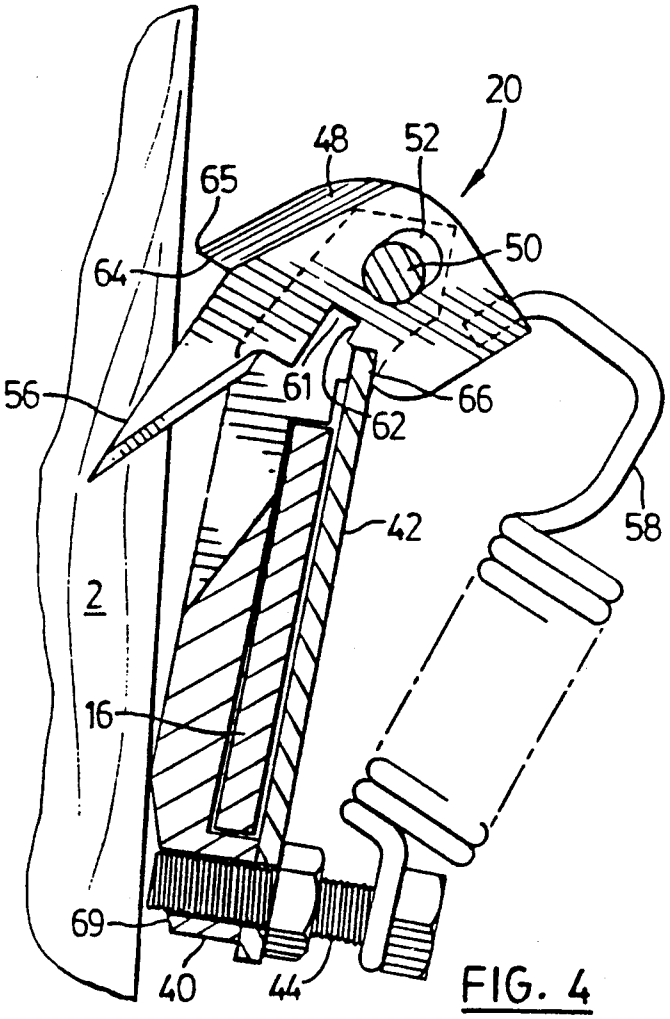
FIG. 4 is a side view and sectional view, along line 3—3, of the safety device in the open or released position.

The front plate 40 includes a recess 46 for housing a tooth 48 as shown in FIG. 2. The tooth 48 is mounted in the front plate 40 using a hinge pin 50. The tooth 48 has a slot 52 which accepts the hinge pin 50. As shown in FIG. 3, the elongated shape of the slot 52 allows both rotational and longitudinal movement of the tooth 48 about the hinge pin 50. In cooperation with the hinge pin 50, the tooth 48 moves between a closed position 54 (FIG. 3) and an open position 56 (FIG. 4).

The tooth 48 is also connected to a strong coil spring 58. As shown in FIGS. 3 and 4, one end of the spring 58 fits into a hole 60 drilled in the top surface of the tooth 48, while the other end of the spring 58 is attached to the bolt 44 to place the spring under tension. The spring 58 and slot 50 are arranged in an "over the centre" configuration. Using such an arrangement, the tooth 48 will stay in the open position 56 until it is pushed back into the closed position 54.

In the closed position 54 shown in FIG. 3, the spring 58 is still in tension and produces a force which tends to pull the tooth 48 into the open position 56. To keep the tooth 48 in the closed position 54, the underside of tooth 48 has a notch 61 defining a release catch 62 which engages with the top edge of the back plate 42. In the closed position 54, the tooth 48 is held against premature release, or flopping out, by the release catch 62 resisting the force of the spring 58. In addition, the spring 58, since it pulls the tooth 48 downwardly, holds the notch 61 firmly over the top edge of the back plate 42.

To release the tooth 48 from the cocked or closed position 54, the tooth 48 includes a barb 64 projecting from the front of tooth 48, near the top of the tooth 48. In its simplest form, the barb 64 is a projection formed or machined as an integral part of the tooth 48. The barb 64 has an edge 65 which will catch the surface of the pole 2 if there is any substantial downward motion, to force the tooth 48 upwards relative to the housing 40.

The tooth 48 also includes a stop catch indicated by 66. The stop catch 66 prevents movement of the tooth 48 past the open position 56. As shown in FIG. 4, the stop catch 66 is simply a forwardly facing surface near the rear of tooth 48, on the underside of the tooth structure. The catch 66 abuts against the top edge of the back plate 42 when the tooth 48 is released or in the open position 56. The shape of the stop catch 66 determines how far the tooth 48 will extend in the open position. The tooth 48 should not extend too much, otherwise the safety device 20 may roll over or tumble which will prevent it from functioning as intended. In the preferred embodiment, the tooth 48 forms an angle of 15 to 30 degrees, preferably 20 degrees, from the vertical when in the open position 56.

To use the belt assembly 10 according to the present invention, the climber 1 places the outer strap 16 around the pole or tree 2 and connects the free ends of strap 16 to his D rings 14. He then connects the cross-strap 18 to outer strap 16. By moving the sliding buckles 30, 31 along the outer strap 16, the loop is adjusted to the diameter of the utility pole 2. There should be just enough tension in the loop formed by straps 16, 18 to prevent the belt assembly from sliding down the pole or tree by its own weight. To accommodate various pole or tree diameters, the length of the cross strap 18 may have to be adjusted. For large diameter poles 2, the outer belt 16 can first be adjusted using the buckle 28. If necessary, the safety device 20 should be repositioned on the outer strap 16 to be directly across from the climber 1 on the opposite face of the pole 2. As mentioned, two or more safety devices 20 can if desired be placed on outer belt 16 to alleviate the need to change their position when the belt loop diameter is changed.

Figure 5:
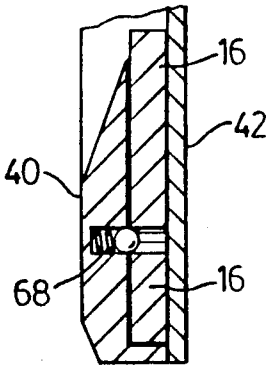
FIG. 5 is a partial sectional view of the safety device and a locking mechanism for positioning the safety device on the belt assembly.

The safety device 20 can be secured in position along the outer strap 16 using a simple conventional spring biased ball 68, as shown in FIG. 5. The ball 68 will pop partly out when the safety device 20 is positioned over one of the adjustment holes in the outer strap 16. Other positioning methods can also be used.

During climbing, the climber would normally grasp the outer belt 16 as shown in FIG. 7 and move it up or down the pole. With the present invention no major change in hand position is needed. The climber still grasps the outer belt 16 as shown in FIG. 7, but now also grasps with it the cross-strap 18, stretching the cross- o strap 18 as shown, away from the pole, so the outer strap 16 is loosened from the pole and can be moved up or down. When the climber releases his grip on the straps, the cross-strap 18 will again tighten the outer strap 16 against the pole.

In the event of a fall, the barb 64 (which can be considered as being an activation device) catches the surface of the utility pole 2 as the climber rapidly moves down the pole 2. Once the barb 64 catches the pole, the barb pulls the tooth 48 upwardly (a translational movement) as allowed by the slot 52. This upward movement of the tooth 48 causes the release catch 62 to clear the top edge of the back plate 42 and the tension of the spring 58 then forces the tooth 48 to rotate into the open position 56. In the open position 56, the tooth 48 will bite into the surface of the utility pole 2. As the downward momentum of the falling climber 1 is transferred to the tooth 48 via the body belt 12, the tooth 48 will penetrate deeper into the pole 2 until the fall is arrested. The force of the fall is taken by the safety device 20 and the outer strap 16; relatively little force is absorbed by the cross-strap or bungee cord 18. In addition the arrest occurs with only a small movement of the safety device, thus limiting the fall distance and the deceleration suffered by the climber.

It will be realized that the translational or upward movement of tooth 48 which occurs before the tooth can rotate, has the advantage of delaying the deployment of the tooth 48 until it is needed. The likelihood of false deployment is thus reduced.

With reference still to FIG. 4, when the tooth 48 bites into the utility pole 2, the safety device 20 will tend to pivot about the point of the tooth 48. To permit greater penetration by the tooth 48, the bottom portion of the front plate can be bevelled as indicated at 69.

To close the tooth 48 after re-setting his spurs in the wood, the climber simply pushes on its front surface (i.e. the surface facing the pole). This rotates the tooth 48 to its FIG. 3 orientation, and spring 58 then pulls the tooth 48 down until notch 61 fits over the top edge of back plate 42.

As noted above, the loop shape formed by the outer strap 16 and cross-strap 18 is adjusted using the sliding buckles 30,31 which fit on the outer strap 16. To keep the sliding buckles 30,31 in their adjusted positions, the buckles 30,31 include locking mechanisms which operate in conjunction with a series of holes 70 in the outer strap 16. FIG. 6*a* shows a first type of locking mechanism 72. The locking mechanism 72 comprises a thumbscrew 74 having a threaded portion 75 directly below the thumbscrew head. The thumbscrew 74 passes through the hole 70 in the outer strap 16 and a corresponding hole 76 in the back plate 34 of the buckle 30,31, with the threaded portion 75 screwing into a corresponding thread in the front plate 32 of the buckle 30, 31 to secure the thumbscrew 74.

Figure 6C:
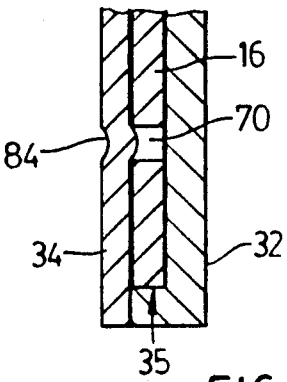
FIG. 6*c* is a sectional view of the sliding buckle and yet another type of retaining mechanism for positioning the buckle on the outer belt.
Figure 6A:
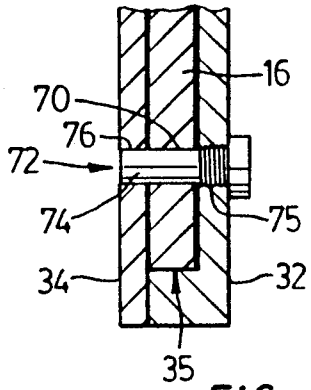
FIG. 6*a* is a sectional view of the sliding buckle and a locking mechanism for positioning the buckle on the outer belt.
Figure 6B:
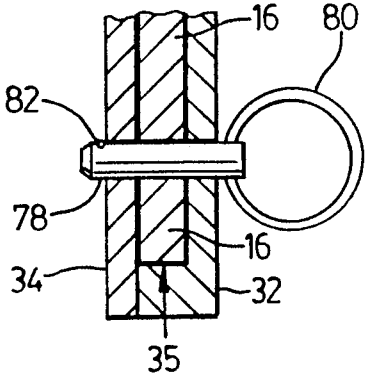
FIG. 6*b* is a sectional view of the sliding buckle and another type of locking mechanism for positioning the buckle on the outer belt.

FIG. 6*b* shows another form of locking mechanism to secure the buckles 30, 31 in position along the outer strap 16. The mechanism comprises a pin 78 having a ring 80 at one end and a spring biased ball 82 at the other end. Pushing the pin 78 through matching holes in the buckle 30, 31 and the outer strap 16 causes the ball 82 to depress until it clears the back plate 34 at which point it pops out to lock the pin 78 against the back plate 34. To remove pin 78 the ring 80 is pulled in the opposite direction which also causes the ball 82 to depress while the pin 78 is being pulled out.

FIG. 6*c* shows a third arrangement for connecting the cross-strap buckles 30, 31 to the outer strap 16. In the FIG. 6*c* arrangement, a simple indent 84 is formed in the back plate 34 of each buckle 30, 31. Since the cross-strap 18 is not load sharing, it need be connected to outer strap 16 only sufficiently tightly that if the entire assembly 10 (minus the climber) were hung on a pole, the cross-strap 18 would hold the outer strap 16 reasonably tightly against the pole. The indents 84 require typically three to five pounds force to move them from one hole 70 in the outer strap to the next. An advantage of the FIG. 6*c* arrangement is that the climber can adjust the position of the cross-strap 18 even while wearing the usual heavy protection gloves.

In a preferred embodiment, the tooth 56 is between 26 and 33 mm long and the barb 64 projects 3 to 6 mm from the surface of the tooth 48.

It will be evident to those skilled in the art that other embodiments of the invention fall within its spirit and scope as defined by the following claims. For example, in some cases the safety device 20 can be made to work without the rotational force of the spring 58. The force generated by the edge of the barb 64 catching the pole can be enough to extend the tooth 48 to the open position 56 where it will bite into the pole 2. Alternatively, different spring arrangements can be used, e.g. tension springs, or two or more smaller and lighter coil springs one or more on each side of the tooth 48, or compression springs arranged to provide a downward force, to keep the tooth normally latched and a rotational force to help extend it once it is unlatched. These springs can be internally positioned within housing 69. In addition, while the barb 64 is shown as integral with the tooth 48, a different arrangement can be used to unlatch the tooth, e.g. a separate moving plate or barb which will catch the pole and move so as to unlatch the tooth 48.

In place of balls 38, simple wear sleeves (e.g. plastic or rubber hose or tubing) in short lengths may be used. Alternatively, more but smaller balls can be used. However it is preferred that these be large enough to provide space for the climber to insert his thumbs between the cross-over strap 18 and the pole 2.

Figure 8:
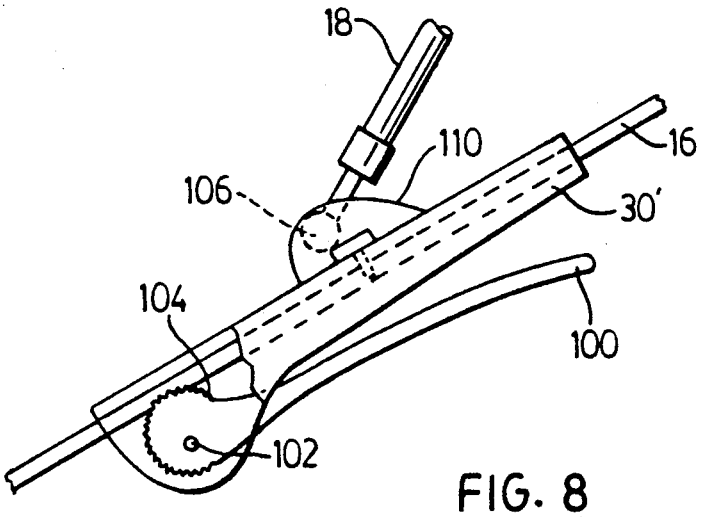
FIG. 8 is a side view of a modified buckle for holding the cross-over strap to the outer strap.
Figure 9:
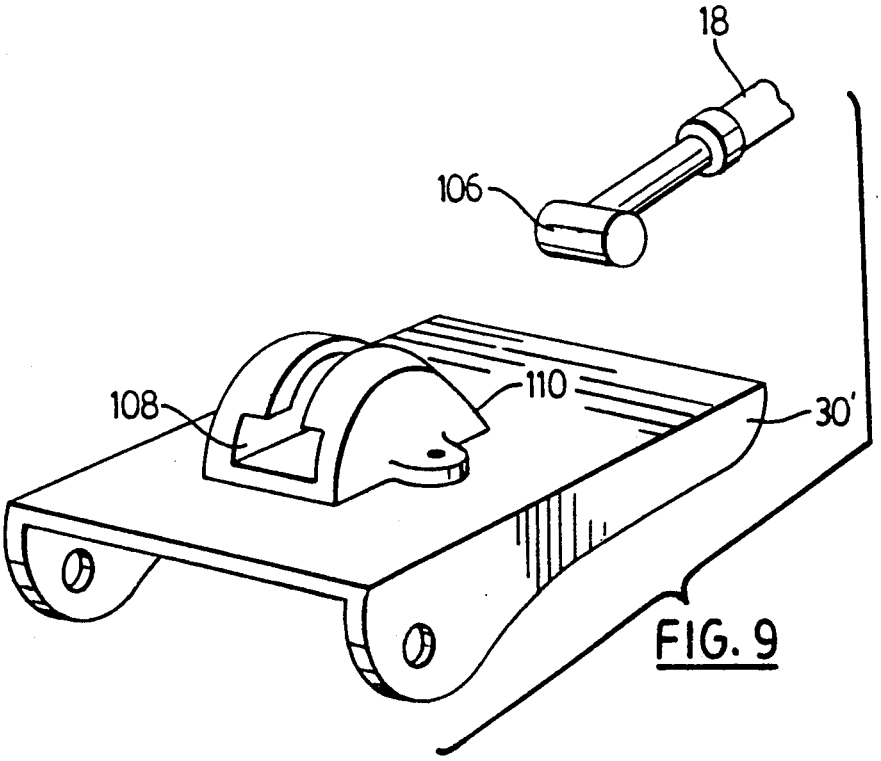
FIG. 9 is a perspective view or a modified connection between the cross-over strap and a buckle on the outer strap.

As shown in FIG. 8, buckles 30, 31 may each be replaced by a buckle 30' having a cam lever 100 which when rotated about pivot shaft 102 forces a toothed cam 104 against outer belt 16, to prevent relative movement between buckle 30' and belt 16. (This kind of arrangement is conventional.) In addition, cross-over strap 18 may have T-shaped end pieces 106 (FIG. 9) which fit into T-shaped slots 108 in bosses 110 on the inner surfaces of buckles 30', to hold the cross-over strap 18 to the outer strap 16. Again, this type of connection is conventional. End pieces 106 could of course be ball-shaped instead of T-shaped.

We claim:

1. A belt assembly for use with a body belt worn by a climber for climbing a utility pole or the like, said belt assembly comprising:

(a) an outer strap adapted to fit around said utility pole, said outer strap having a pair of ends adapted to be attached to said body belt, (b) a cross-over strap having a pair of ends connected to said outer strap at locations spaced from the ends of said outer strap, said cross-over strap being adapted to define and maintain, with a portion of said outer strap extending between the ends of said cross-over strap, a closed snug loop around said pole, (c) a safety device connected to said portion of said outer strap, (d) said safety device having a tooth, and means mounting said tooth for movement between an open position and a closed position, (e) said safety device further including latching means coupled to said tooth and normally retaining said tooth in said closed position, (f) said safety device including tooth deployment means responsive to said climber falling, for releasing said tooth from said latching means and for moving said tooth into said open position so that said tooth will penetrate into said pole, said deployment means including activation means for contacting said pole if said climber falls, for initiating operation of said deployment means.

2. A belt assembly as claimed in claim 1, wherein said activation means includes a barb positioned on a front surface of said tooth and adapted to extend toward said pole.

3. A belt assembly as claimed in claim 2, wherein said deployment means includes a spring means for biasing said tooth towards said open position.

4. A belt assembly as claimed in claim 2, wherein said safety device includes a housing, said mounting means comprising a pin extending through an upper part of said tooth and through said housing, one of said tooth and said housing having a slot therein to permit said tooth to undergo sequential translational and rotational movement relative to said housing as said tooth moves between said open and closed positions.

5. A belt assembly as claimed in claim 4, wherein said latching means includes catch means in said housing engaging said tooth when said tooth is in said closed position, said translational movement carrying said tooth into and out of engagement with said catch means.

6. A belt assembly as claimed in claim 5, wherein said housing comprises front and back plates defining a slot between them to receive said outer strap.

7. A belt assembly as claimed in claim 6, wherein said catch means comprises a notch in a lower portion of said tooth, and an upper edge of said back plate, said upper edge being adapted to fit within said notch.

8. A belt assembly as claimed in claim 7, wherein said tooth includes a stop surface to limit movement of said tooth past said open position.

9. A belt assembly as claimed in claim 4, wherein said housing includes a recess therein, said tooth lying within said recess when said tooth is in its closed position, and said barb then projecting from said recess.

10. A belt assembly according claim 1, wherein said cross-over strap is of resilient material for normally maintaining said closed loop in tension about said pole.

11. A belt assembly according claim 1, wherein said cross-over strap is of resilient material for normally holding said closed loop in tension about said pole, and including standoff means on said cross-over strap to hold a portion of said cross-over strap out of contact with said pole, thus to reduce abrasion of said cross-over strap.

12. A belt assembly according to claim 1 and including means for adjusting the positions of the ends of said cross-over strap on said outer strap, said cross-over strap comprising elastic cord material, and at least two standoff members mounted on said cross-over strap, said standoff members being rotatably mounted on said cross-over strap.

13. A belt assembly according to claim 1 and including means for adjusting the positions of the ends of said cross-over strap on said outer strap, said cross-over strap comprising elastic cord material, and at least two ball members rotatably mounted at fixed positions on said cross-over strap, said ball members being spaced apart from each other and from the ends of said cross-over strap.

* * * * *